US009085911B2

(12) United States Patent
Sabillon

(10) Patent No.: US 9,085,911 B2
(45) Date of Patent: Jul. 21, 2015

(54) METHOD FOR FEED THROUGH CONSTRUCTION

(71) Applicant: German Jose Sabillon, Milwaukie, OR (US)

(72) Inventor: German Jose Sabillon, Milwaukie, OR (US)

( * ) Notice: Subject to any disclaimer, the term of this patent is extended or adjusted under 35 U.S.C. 154(b) by 0 days.

(21) Appl. No.: 14/466,978

(22) Filed: Aug. 23, 2014

(65) Prior Publication Data

US 2014/0360127 A1 Dec. 11, 2014

Related U.S. Application Data

(62) Division of application No. 13/179,493, filed on Jul. 9, 2011, now Pat. No. 8,813,447.

(51) Int. Cl.

| | |
|---|---|
| ***E04B 1/00*** | (2006.01) |
| ***E04G 21/00*** | (2006.01) |
| ***E04G 23/00*** | (2006.01) |
| ***E04F 21/00*** | (2006.01) |
| ***E04G 15/06*** | (2006.01) |
| ***E04C 2/52*** | (2006.01) |
| ***E04B 5/00*** | (2006.01) |

(52) U.S. Cl.

CPC . *E04F 21/00* (2013.01); *E04B 5/00* (2013.01); *E04C 2/52* (2013.01); *E04G 15/06* (2013.01)

(58) Field of Classification Search

CPC ..... E04B 5/00; E04B 1/3211; E04C 3/35; E04C 2/52; E04G 15/06

USPC ..... 52/248, 220.8, 223.3, 245, 745.1

See application file for complete search history.

(56) References Cited

U.S. PATENT DOCUMENTS

| | | | | | |
|---|---|---|---|---|---|
| 1,260,024 | A * | 3/1918 | Parton | 52/302.3 |
| 2,035,764 | A * | 3/1936 | Rowell | 52/247 |
| 2,074,592 | A * | 3/1937 | Rowell | 52/223.3 |
| 2,524,126 | A * | 10/1950 | Howard | 52/248 |
| 3,014,559 | A * | 12/1961 | Rogers | 52/245 |
| 3,488,965 | A * | 1/1970 | Chesnov | 405/151 |
| 3,640,038 | A * | 2/1972 | Heron | 52/223.3 |
| 3,648,303 | A * | 3/1972 | Stewart et al. | 52/5 |
| 3,951,294 | A * | 4/1976 | Wilson | 220/4.31 |
| 4,982,535 | A * | 1/1991 | Pickett | 52/71 |
| 7,150,128 | B2 * | 12/2006 | Schuman et al. | 52/105 |
| 7,966,786 | B2 * | 6/2011 | Koteskey | 52/745.19 |
| 2008/0178539 | A1 * | 7/2008 | Brodsky | 52/105 |

* cited by examiner

*Primary Examiner* — Brian Glessner
*Assistant Examiner* — Paola Agudelo

(57) ABSTRACT

A method for creating a feed through construction barrier comprised of a collar defining the form factor of the barrier and a plurality of slidably connected and nested rods creating a continuous barrier conforming to the form factor of the collar. While the collar defines the form factor of the barrier, the slidable rods can be adjusted in their relative positions along the form factor to provide for a barrier that conforms to the contours of the application surface. The barrier may include means to attach the apparatus to the decking and caps to seal the apparatus during construction activities. The rods are interconnected one to another so that the rods can be connected into a continuous barrier. The rods are able to slide relative to each other along the interlocking structure. When the device is set into position, rods may be slid into a barrier structure that conforms to both planar and non-planar surfaces of the application surface. As such, the method provides for an effective barrier for further construction processes, e.g. pouring a cement floor while keeping cement from flowing into the desired channel or penetration.

8 Claims, 6 Drawing Sheets

METHOD FOR FEED THROUGH CONSTRUCTION

RELATED APPLICATIONS

This application is a divisional of application Ser. No. 13/179,493 filed Jul. 9, 2011, and titled "Apparatus and Method for Feed Through Construction".

FIELD OF THE INVENTION

This invention relates to a construction method for creating portals in a constructed structure and in particular to creating portals in poured concrete flooring.

BACKGROUND

A sleeve creates an opening known as a penetration or hole between floors of buildings or other structures essential for various trades (i.e. electrical, plumbing, sprinkler fitting). Plumbing processes and mechanical needs are routed using penetrations to maximize efficiency and minimize materials used. Large penetrations called shafts are utilized to connect each floor for large duct work and system pipes, however congestion in those shafts is avoided by having drain and vent pipes plumbed through penetrations. Electrical and data needs can be brought up through the floor as well.

In buildings with floors made of metal decking and concrete, or just concrete, passages are created utilizing, for example, a core drilling method or a boxing out method. The core drilling method generally includes a core drill rig, specialized wet core bits and water. The concrete is poured, creating the floor without any penetration. Once the concrete cures, holes of various sizes are drilled using a core drill rig with a wet core bit. This method requires a water source to keep the bit cool, two people (one to keep watch bellow while the other cuts), clean up and a lot of time.

The boxing out method includes structures and material such as wood frames or forms and Styrofoam or dense insulation foam board. The boxing out method allows for the deck to retain structural integrity during a concrete pour. This method is discouraged due to the resulting seams created from multiple concrete pours called cold joints. Cold joints are of inferior quality when a water tight finished floor is necessary. The boxing out method is also time-consuming.

The Sleeve method avoids potentials for cold joints however there are several disadvantages. If a sleeve is wrongly placed (knocked over) and concrete is poured you must resort to core drilling to make the correction. This often requires cutting into the existing sleeve. Since most sleeves are made with ferrous materials, cutting time is increased. The anchors do not allow for easy physical manipulation. Cutting the anchors along with the decking material after the pour of concrete is also difficult since the anchors consist of high strength steel. The PVC used in this method easily catches on fire when the decking is finally cut through with a torch. Tin sleeves are easy to cut to meet the profile of the deck, but the material is thin and can easily be dented or torn off due to its lack of structural strength. Duct tape, styrofoam, and insulation boards are used to fill in the odd shaped voids, however some problems arise with the use of these materials. Keeping the foam in place is difficult, the duct tape used to seal around the base and seams does not adhere well when the weather is cold, and the insulation boards along with the other materials burns and melts easily. Other weather factors prevent the surfaces from being dry.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings.

DETAILED DESCRIPTION OF THE INVENTION

Figure 1:
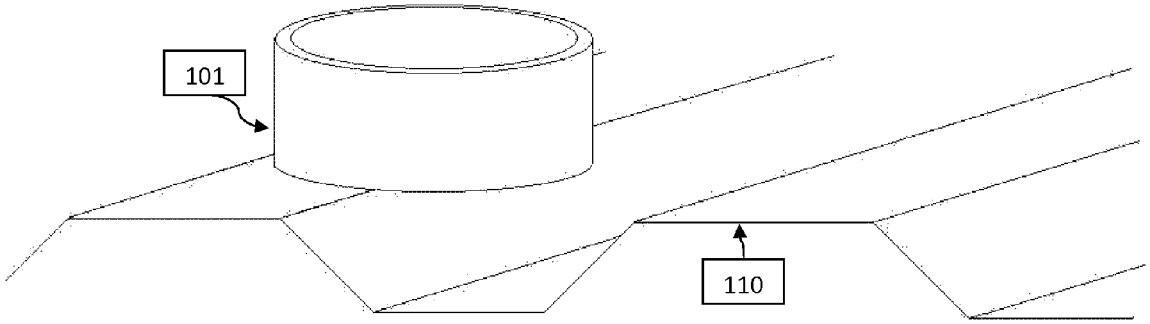
FIG. 1. Collar placed on top flute of metal deck shown.
Figure 2:
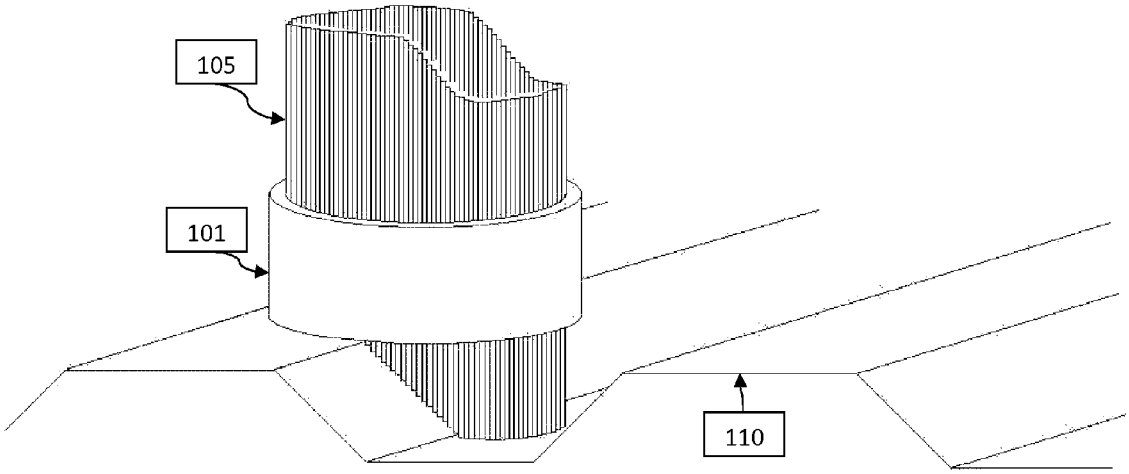
FIG. 2. Collar with rods meeting deck profile shown.
Figure 3:
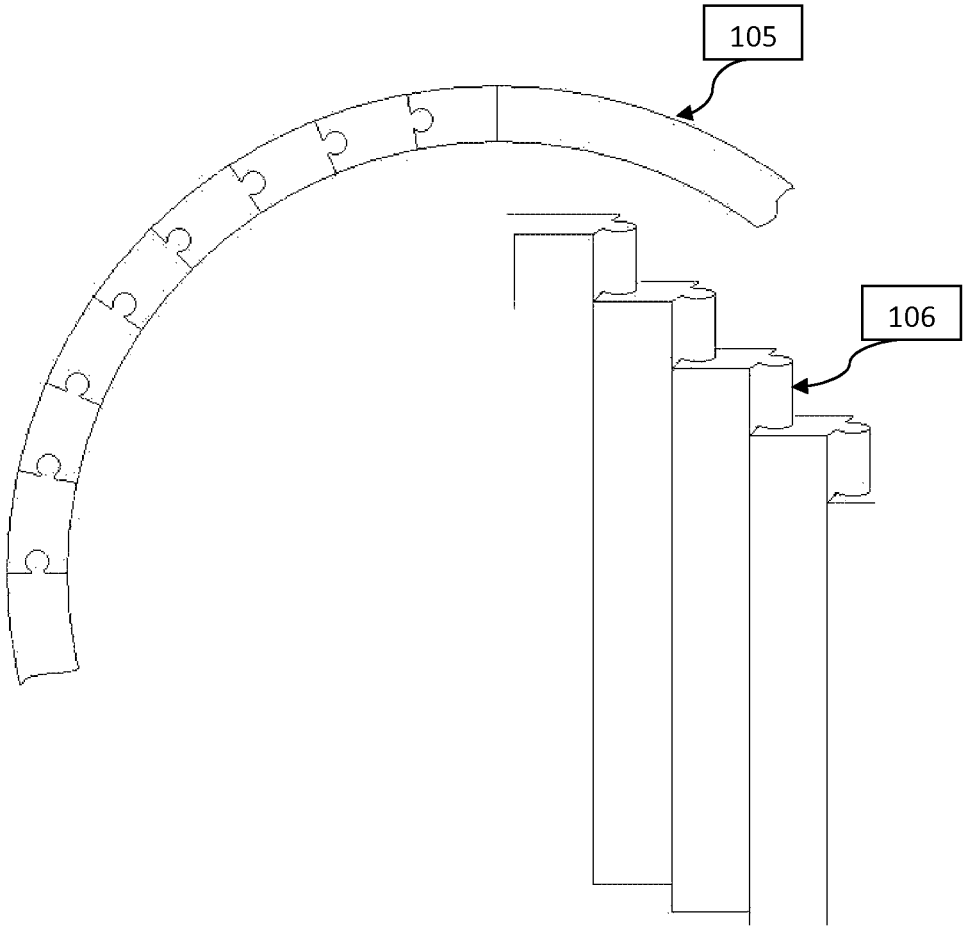
FIG. 3. Top & side view of rods with interlocking & sliding features shown.
Figure 4:
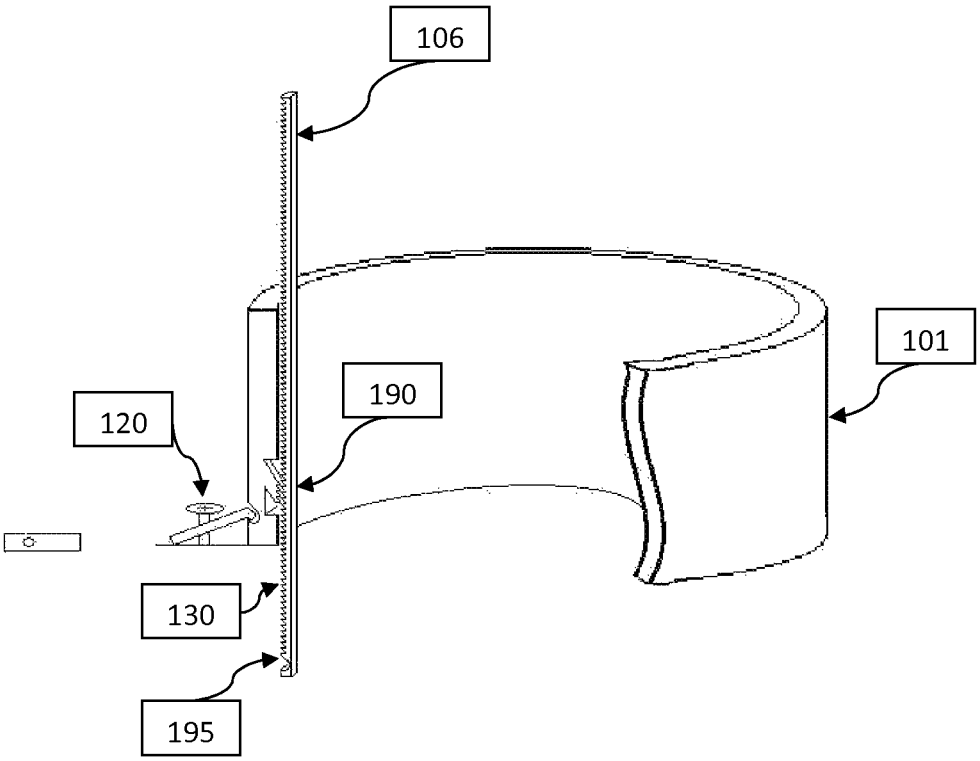
FIG. 4. Collar with hold-down clip. Rod with locking mechanism.
Figure 5:
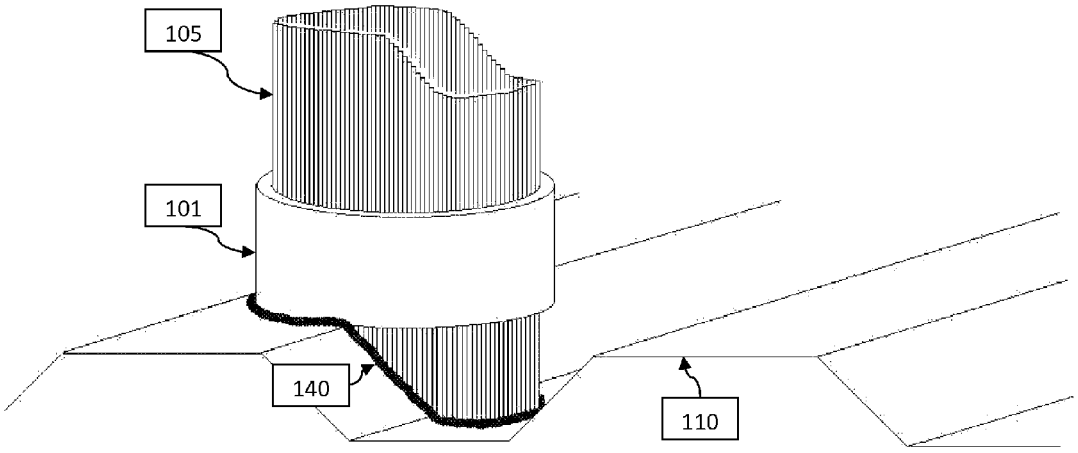
FIG. 5. Collar with rods and sealant along mating surface.
Figure 6:
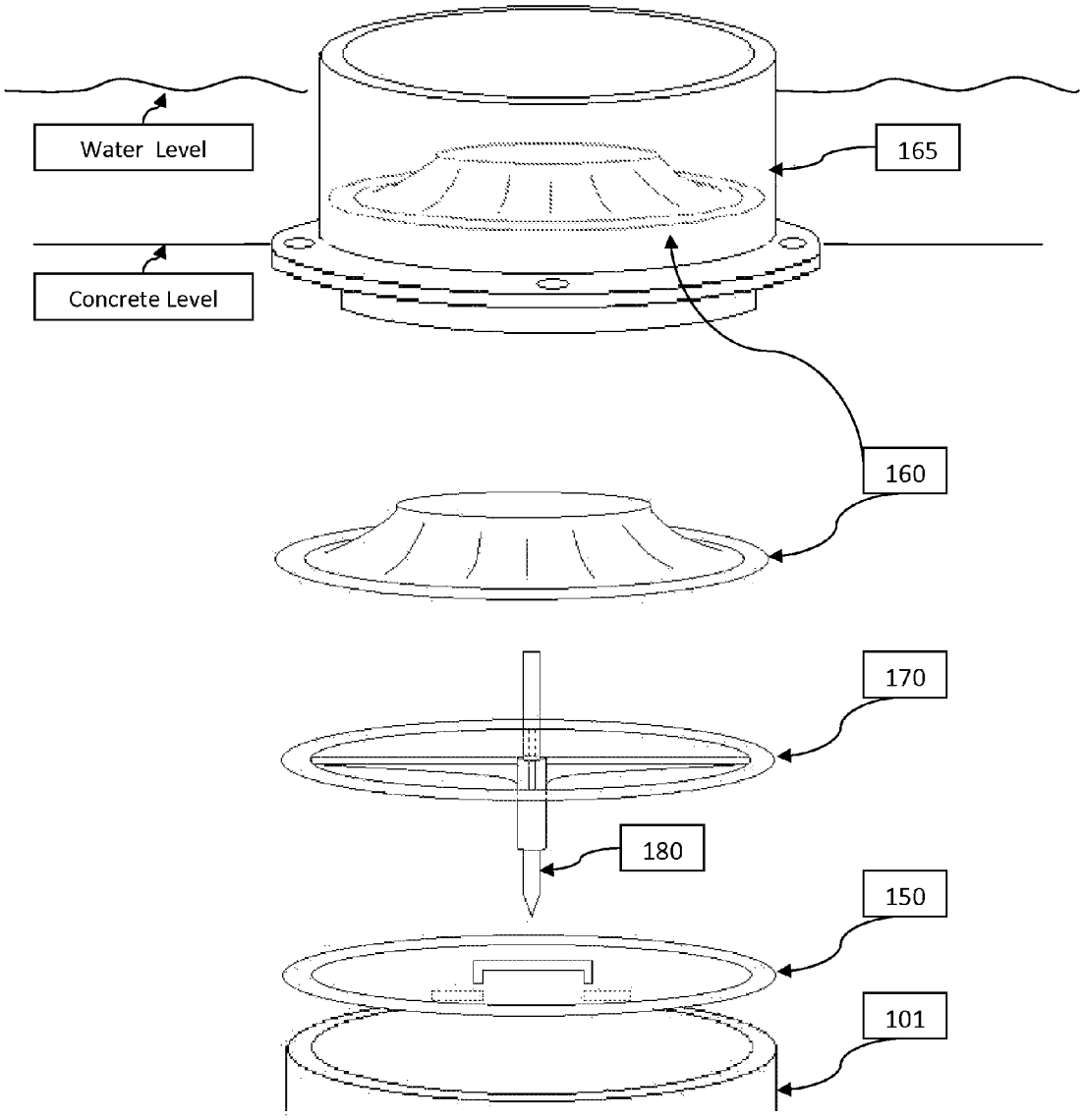
FIG. 6. Fire proofing membrane, alignment tool, temporary cap, and water collar.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention may be practiced without one or more of the specific features or advantages of a particular embodiment. In other instances, additional features and advantages may be recognized in certain embodiments that may not be present in all embodiments of the invention.

These features and advantages of the present invention will become more fully apparent from the following description and appended claims, or may be learned by the practice of the invention as set forth hereinafter.

Various embodiments of the present invention are comprised of a collar 101 defining the form factor of the apparatus and a plurality of slidably connected and nested rods 105, 106 creating a continuous barrier conforming to the form factor of the collar 101. While the collar 101 defines the form factor of the barrier, the slidable rods 105, 106 can be adjusted in their relative positions along the form factor to provide for a barrier that conforms to the contours of the decking 110 or obstructions. Further embodiments include means to attach the apparatus to the decking and caps to seal the apparatus during construction activities.

In one embodiment the rods 106 are interconnected one to another through a male-female interlocking structure so that the rods can be connected into a continuous barrier 105. The rods 106 are able to slide relative to each other along the interlocking structure. When the device is set into position, rods may be slid into a barrier structure that conforms to both planar and non-planar surfaces of the decking 110. As such, the barrier will be able to provide an effective barrier for further construction processes, e.g. pouring a cement floor while keeping cement from flowing into the desired channel or penetration.

In some embodiments the caps 150, 160, rods 106, and collars 101 may be made of plastic. The plastic would preferably conform to the following. Sleeves could be used in various environments and would preferably be suitable for different temperatures and humidity levels. Plastic should not become brittle or easily deformed. The plastic would preferably resist chemicals, solvents, and other material it comes in contact with (such as concrete & sealants). Various sizes, representing various form factors would be available to accommodate the demand for all pipes penetrating through the floor. Some sleeve sizes could be determined by the outside diameters of available hole saws. The plastic would preferably be easily cut with a diamond wire cutter or similar tool and be strong enough to stand on and maintain its installed position with rigidity. It would be advantageous in some embodiments that the plastic be a highly visible color to reduce tripping hazard of persons working and moving in the locality of the sleeve.

The barrier structure can be anchored to the decking or other surrounding supporting structures. In one embodiment the barrier structure can be anchored using hold-down clips 120. Hold-down clips 120 should be strong enough to resist movement of the barrier structure during construction activities or accidental bumping of the barrier structure after it is placed. In one embodiment the hold-down clips 120 are to be made of high strength steel. Clips 120 should to be strong enough to hold the barrier securely in place. Clips 120 should not deform easily and they should retain their original shape. Sheet metal screws can be used on metal decks to anchor the clips 120 to the deck 110.

A further embodiment includes the use of sealing material 140 to fill in any gaps between the barrier formed by the rods 105 and the surface upon which the barrier is resting 110, e.g. construction decking. The sealing material 140 can be in the form of gaskets, weather sealing tape, glues/silicones/puddy/caulk/mastic, or tape or other such items. In one embodiment the material should preferably adhere to the base material (metal decking, wood, etc.) in humid and hot or cold environments. In one application example the sealing is used to keep the poured concrete from entering the void the barrier is intended to create.

The instant barrier structure comprises two major components: a collar 101 and a plurality of interconnected rods 105, 106. For construction applications, collars 101 would preferably be manufactured in predetermined heights depending on the final thickness of the concrete that will be poured on the deck. Such collars 101 would preferably be installed level with the top flute of the deck 110. In one embodiment, the bottom rim of the outside surface of the collar 101 would have a recess to allow a metal hold-down clip to anchor the collar 101 to the deck 110. In another embodiment, the segment inside the collar would serve as a ratcheting locking mechanism 190, interfacing with the slidable rods 130 and allowing the rods to only move in one direction (e.g. down toward the deck).

The collars 101 may be manufactured via a variety of standard production processes. In one production mode injection molds would facilitate the speed and accuracy of the collar production.

The geometry and shape of the rods 106 should provide the barrier with the strength needed to withstand the pressures that will be exerted on it. In one embodiment, the rods 106, along their axis, have a "key stone" shape that keeps the rods 106 interlocked with each other keeping the barrier they create from collapsing. The rods are keyed to allow them to slide one with respect to one another. One side has a guide that will slide inside the adjacent rod while the other will have an inversely receiving cavity for the guide of an adjacent rod.

One embodiment would have fine teeth 130 along the outside of the rod that will serve as a one-way lock with the collar 190, 101. These teeth 130 would be angled to allow easy insertion but will have an acute angle that will prevent it from sliding in the opposite (e.g. upward) direction. Ina a further embodiment, a recessed location 195 would also be available at the bottom end of the rods 106 for the use of the hold-down clips 120 for additional anchoring points.

A further embodiment of the barrier includes caps or covers 150, 170, 160 useful e.g. during the construction process. The caps 150, 160 may be made from a variety of materials, e.g. plastic. Various types of caps (or covers) would be available to facilitate effective and safe construction techniques. In one embodiment, a blind cap 150 with a smooth top would be used for the pouring process and when the hole is not in use. The cap 150 would preferably have a clean flat surface on top to keep it from interfering with the leveling of the concrete. In a further embodiment the cap 150 may include a handle that would facilitate the removal of the cap 150. The cap 150 may be reinforced as needed to withstand significant weight placed on top (especially on barriers with a large surface area).

In a further embodiment an alignment cap 170 (adapted to the top of the collar) would aid in the centering of the sleeve and could consist of spoke like wheels 170 converging on a center guide. A shaft 180 would be inserted into this guide at the center of the spokes 170 and slid up and down to pin point the proper location on the deck.

In a further embodiment, a cap 160 with a long plastic skirt (that will match the contour of the inside of the sleeve and can be glued to the sleeve) can be installed at the time the pipe is inserted. It would have a rubber, or similar material, diaphragm (with a smaller diameter than the pipe) that would serve as a fire proofing membrane. It would fit snug against the pipe when inserted.

Barriers can be used wherever penetrations through floors in buildings are needed. Rods 105, 106 will enable installation of the sleeves in various floor thicknesses. The profile matching characteristics will make the sleeves suitable to many different metal decking designs. On floors poured as a single flat slab the sleeves could still be installed by having the collar 101 slide up evenly on the rods to the desired depth.

In one embodiment barriers are installed by following these steps: Proper sleeve location is established as accurately as possible. When determining the center of the barrier by measuring off of grid lines, the centering cap 170, 180 can assist in precisely pin pointing the proper placement for installment. Once the center is found, the collar 101 can be secured to the deck 110 with the hold-down clips 120. Weather sealing tape 140 can be installed between the collar and the deck at this time. If other methods of sealing 140 are preferred then they can be applied after the sleeve rods 105 have been installed. Rods 105, 106 can be inserted after the collar 101 is secured to the decking 110. Rods 106 would slide down the inside of the collar 101 until properly seated against the deck 110. Each individual rod should be checked to eliminate any gaps between the deck and the sleeve. Where possible the rods 105, 106 should be secured to the deck 110. This could be accomplished with hold-down clips 120 as were used on the collar 101 to aid in stability of the sleeve. Remaining rod material left above the desired level can be sheared off with a diamond impregnated wire blade, hand saw, plastic tubing cutters, hack saw, portable band saw, saws all, etc. Cap

150 is to be installed to reinforce the sleeve in case it gets bumped or stepped on or otherwise disturbed during the concrete pouring process to keep concrete out. Cap 150 should be kept on after the decking has been cut to keep debris from falling through, eliminate a tripping hazard, and from equipment tipping over. The use of a fire proofing sleeve 160 is optional and would preferably be installed in unison with the pipe and water collar.

A further embodiment includes an extension 165 to the sleeve that is within the concrete. It can be made of variable heights and diameters. For safety reasons it would serve as a water barrier in mechanical rooms in case of flooding. The water would be contained in that room preventing flow from seeping thru the sleeve to rooms below. Within the sleeve the same fire proofing membrane would be built in. The extension 165 could have a flange at concrete level to aid in securing it to the floor. A gasket, rubber ring, or sealant could be placed in between the concrete and the flange to make it water tight. This extension 165 would be strong enough to support the pipe protruding through the floor with the use of riser clamps.

In a further embodiment, if the height of the water level is known, another way to accomplish this would be to have the sleeve 101 initially made and installed to final specifications.

The above description discloses the invention including preferred embodiments thereof. The examples and embodiments disclosed herein are to be construed as merely illustrative and not a limitation of the scope of the present invention in any way. It will be obvious to those having skill in the art that many changes may be made to the details of the above-described embodiments without departing from the underlying principles of the invention.

What is claimed is:

1. A method for constructing feed through hole barrier comprising:

securing a collar to a construction deck;

wherein said collar provides a guide for the shape of said barrier;

said collar further comprises a locking structure;

wherein said locking structure inhibits motion of said rods in one direction;

inserting a plurality of rods inside said collar;

wherein said rods are slidably connected one to another;

said rods having teeth along said rod that interconnect with said locking structure wherein said teeth serve as a directional one-way lock of the position of said rods;

wherein said plurality of rods form a continuous surface; and sliding said rods until rods are seated against said deck.

2. The method of claim 1 wherein said collar is secured to said construction deck with hold-down clips.

3. The method of claim 1 wherein said rods are secured to said construction deck with hold-down clips.

4. The method of claim 1 further comprising removing the portion of said rods that are protruding above the desired barrier height.

5. The method of claim 4 further comprising installing a cap over said rods.

6. The method of claim 1 further comprising installing weather sealing tape between said collar and the construction deck.

7. The method of claim 1 wherein:

said rods have a principal axis;

said rods have a key stone shape along their axis;

said rods have a grove shape matching said key stone shape;

wherein said key stone shape in one rod interlocks with said matching grove in another rod.

8. The method of claim 1 further comprising:

a second hold down clip;

further anchoring said collar to said deck using said second hold down clip.

* * * * *